US008240371B2

(12) United States Patent
Tepavac et al.

(10) Patent No.: US 8,240,371 B2
(45) Date of Patent: Aug. 14, 2012

(54) MULTI-FUNCTION SUB FOR USE WITH CASING RUNNING STRING

(75) Inventors: Radovan Tepavac, Calgary (CA); Milo Markovic, Calgary (CA)

(73) Assignee: Tesco Corporation, Houston, TX (US)

( * ) Notice: Subject to any disclaimer, the term of this patent is extended or adjusted under 35 U.S.C. 154(b) by 420 days.

(21) Appl. No.: 12/484,367

(22) Filed: Jun. 15, 2009

(65) Prior Publication Data

US 2010/0314100 A1 Dec. 16, 2010

(51) Int. Cl.
*E21B 19/00* (2006.01)
*E21B 19/16* (2006.01)

(52) U.S. Cl. ..... 166/77.51; 166/85.1

(58) Field of Classification Search ..... 166/77.51, 166/85.1

See application file for complete search history.

(56) References Cited

U.S. PATENT DOCUMENTS

| | | | | |
|---|---|---|---|---|
| 4,781,359 | A * | 11/1988 | Matus | 267/71 |
| 5,347,859 | A | 9/1994 | Henneuse et al. | |
| 6,527,493 | B1 | 3/2003 | Kamphorst et al. | |
| 6,688,398 | B2 | 2/2004 | Pietras | |
| 7,090,021 | B2 | 8/2006 | Pietras | |
| 7,281,587 | B2 | 10/2007 | Haugen | |
| 2008/0125876 | A1 * | 5/2008 | Boutwell | 700/21 |
| 2008/0202810 | A1 | 8/2008 | Gomez | |
| 2010/0163248 | A1 * | 7/2010 | Robichaux et al. | 166/381 |

FOREIGN PATENT DOCUMENTS

WO WO96/18799 6/1996

OTHER PUBLICATIONS

Downhole Technology, Ltd. (NOBLE)—Instrumented Surface Sub—DOE Project (DE-FC26-03NT41782)—pp. 1-12.

* cited by examiner

*Primary Examiner* — David Andrews
(74) *Attorney, Agent, or Firm* — Bracewell & Giuliani LLP

(57) ABSTRACT

A multi-function sub is connected between a top drive of a drilling rig and a casing gripper. The sub has telescoping upper and lower members that rotate with each other. A sleeve is mounted to one of the members. That sleeve is prevented from rotation with the upper and lower members by an anti-rotation device. A piston is located on the other member and reciprocally carried within the sleeve. An external pump is connected to the sleeve for supplying pressurized fluid into the sleeve to act against the piston. This fluid provides compensation for thread makeup when a new joint of casing is being secured to a string of casing.

13 Claims, 5 Drawing Sheets

MULTI-FUNCTION SUB FOR USE WITH CASING RUNNING STRING

FIELD OF THE INVENTION

This invention relates in general to oil well drilling and casing equipment and in particular to a sub connected between a top drive and a casing gripper to compensate for thread makeup and provide signals corresponding to torque, weight and rotations per minute of the string.

BACKGROUND OF THE INVENTION

The most common way of drilling an oil or gas well involves attaching a drill bit to a string of drill pipe and rotating the drill pipe to drill the well. At selected depths, the operator retrieves the drill pipe and runs a string of casing to line the well bore. The operator cements the casing in place. The operator may then continue to drill deeper with the drill pipe and run additional strings of casing.

Another method uses the casing itself as the drill string. The operator employs a casing gripper that will grip the upper end of the casing string to support its weight as well as transmit rotation. The casing gripper is mounted to a top drive. The top drive runs up and down the derrick on one or more guide rails and imparts rotation to the casing gripper.

There are different methods of running casing. One technique involves using casing elevators to support the string of casing and power tongs at the rig floor to make up each new joint of casing to the string of casing. With another method, the operator uses a casing gripper that may be of the same type as employed during casing drilling. By rotating the casing gripper, the operator imparts rotation to a new joint of casing to make up its lower end with the casing string suspended at the rig floor.

When running casing with a casing gripper connected to a top drive, it is known to employ a thread makeup compensator. A thread makeup compensator comprises a telescoping sub that is mounted between the top drive and the casing gripper. The sub extends while the top drive is held at a stationary elevation and rotating the casing gripper to compensate for the casing joint moving downward as its threads are made up to the threads of the casing string.

It is also known in the art to provide data to rig floor personnel concerning the thread makeup of casing joints. This data may include the torque applied to the casing joint while making it up. It has also been proposed to provide data concerning the tension within the casing string. It is also known in the prior art to monitor the rotational speed of the string of pipe in various manners. While thread makeup compensator systems and data sensing of the prior art are feasible, improvements are desired.

SUMMARY OF THE INVENTION

In this invention, a multi-function sub is provided for connecting between a casing gripper and a top drive. The multi-function sub includes a thread makeup portion that compensates for a casing joint traveling downward a short distance as it is being made up to a casing string. A torque measuring gage is mounted to the sub for measuring torque applied to make up the joint of casing with a casing string. A tension measuring gage may be mounted on the sub for measuring tension applied through the sub so that the weight of the string is known. Furthermore, a rotation sensing gage may be mounted to the sub for sensing a speed of rotation of the casing joint.

In the preferred embodiment, an annular cavity is formed in the sub concentric with the longitudinal axis of the sub. The torque and tension gages are mounted within the cavity. An annular instrument housing is mounted around the sub, enclosing the cavity. Circuitry for the gages, one or more batteries and an RF transmitter may be mounted within the instrument housing.

The multi-function sub has upper and lower members that will telescope relative to each other. One of the members is mounted to the top drive and the other to the casing gripping device. The thread makeup compensating portion includes a sleeve that is mounted to one of the members. An anti-rotation device prevents rotation of the sleeve with the upper and lower members. A piston is located on the other member and reciprocally carried within the sleeve. An external pump is connected by a line to the sleeve for supplying pressurized fluid into the sleeve, which acts against the piston to bias the upper and lower members to a contracted position.

The anti-rotation member may comprise a rigid link connected to a stationary portion of the top drive and extending down into cooperative engagement with the sleeve. The rotation sensing device may have a non-rotating portion mounted on and extending outward from the sleeve. The rigid link that prevents rotation of the sleeve also contacts the rotation sensing device to prevent its rotation. A rotating portion of the rotation sensing device is mounted to one of the upper and lower members for rotation therewith.

DETAILED DESCRIPTION OF THE INVENTION

Figure 1:
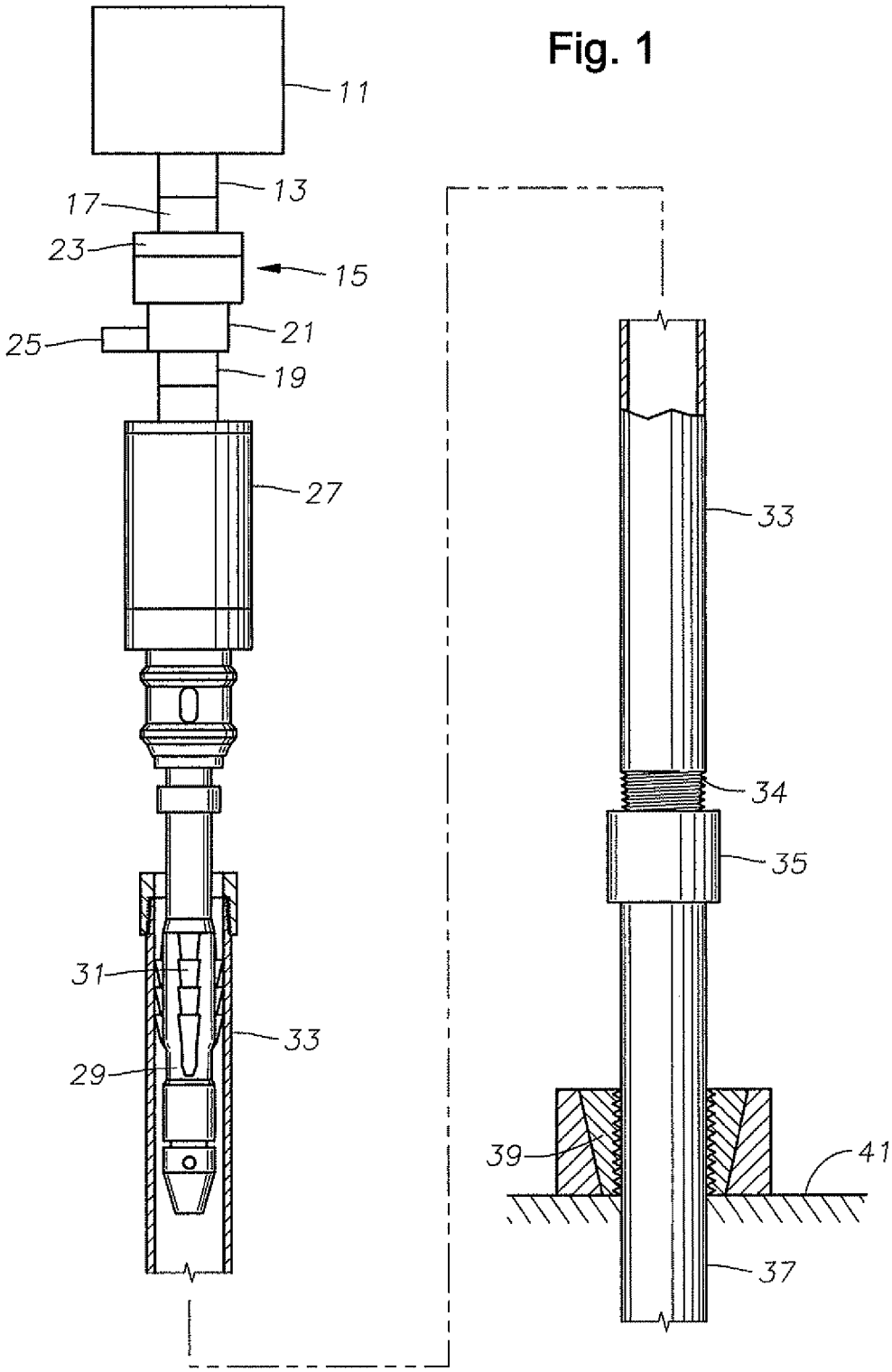
FIG. 1 is a schematic view illustrating a multi-function sub connected between the top drive and a casing gripper, and shown in the process of connecting a new joint of casing to a suspended casing string.

Referring to FIG. 1, a top drive 11 is mounted in a drill rig for movement up and down the mast or derrick of the rig (not shown). Top drive 11 imparts rotation to a quill 13, which is a drive shaft having a threaded connection at its lower end. A multi-function sub 15 mounts to quill 13 and has an upper member 17 and a lower member 19 that are axially movable or telescoping relative to each other. Upper member 17 has threads that engage threads of quill 13. A thread makeup compensator sleeve 21 is connected with sub 15. Sleeve 21 urges lower member 19 upward toward a contracted position for multi-function sub 15.

An annular instrument housing 23 is mounted around an upper portion of multi-function sub 15. Instrument housing 23 provides signals, preferably wireless, to a receiver (not shown) accessible to operating personnel. The signals include data concerning the torque being applied by top drive 11 and the weight of the equipment suspended below multi-function sub 15. A rotation sensor 25 is mounted to sleeve 21 for detecting the rotational speed of lower member 19 and transmitting a signal to the receiver.

A conventional casing gripper 27 mounts to lower member 19 of multi-function sub 15. Casing gripper 27 in this example has a spear 29 containing grippers 31. Grippers 31 are movable radially outward into engagement with the inner diameter of a casing joint 33. Alternately, grippers 31 could be mounted to an external sleeve that slides over and grips the exterior of casing joint 33. Casing gripper 27 is supplied with hydraulic fluid pressure for causing the radial movement of grippers 31.

Casing joint 33 is depicted as being a single section or joint of casing that has external threads 34 on its lower end for securing to an internally threaded casing collar 35. Casing collar 35 is located on the uppermost joint of casing of a casing string 37 suspended at the rig floor. The term "casing" is used broadly herein to also include other tubular pipes used to line and be cemented within a well bore, such as liner pipe. Casing string 37 is shown suspended by slips or spider 39 located at a rig floor 41. The portion of casing string 37 protruding above spider 39 is sometimes called a "stump".

Figure 2:
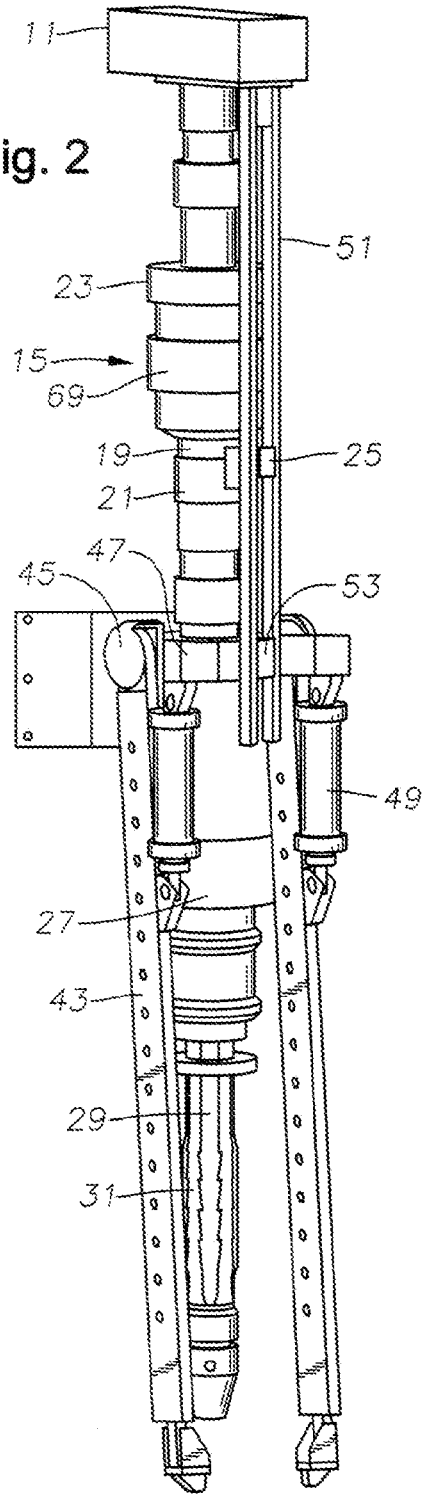
FIG. 2 is a perspective view illustrating the multi-function sub of FIG. 1 connected between the top drive and the casing gripper.
Figure 4:
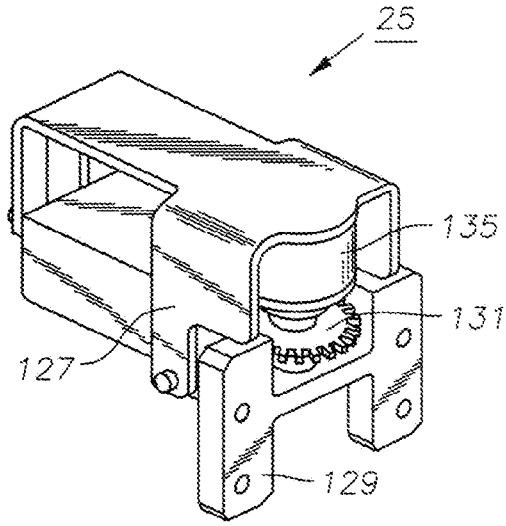
FIG. 4 is an enlarged, perspective view of a rotation sensing unit of the sub of FIG. 1 for determining rotational speed.

FIG. 2 is a more detailed external view of many of the components discussed in connection with FIG. 1. FIG. 2 illustrates that casing gripper 27 has a pair of bails or links 43 that extend downward. Bails 43 are used to support a pipe elevator (not shown) which is a clamp employed for lifting a new joint of casing 33. Bails 43 are pivotally mounted to trunions or cylindrical axles 45 so that they each is constrained to swing in a single plane. Trunions 45 are mounted to a top bracket 47. Bearings (not shown) are located between top bracket 47 and rotating portions of casing gripper 27. A fluid cylinder 49 is attached between top bracket 47 and each bail 43. Fluid cylinders 49 are used to pivot bails 43 and are normally supplied with hydraulic fluid.

At least one, and preferably two anti-rotation links 51 are secured to a non-rotating portion of top drive 11. Links 51 are parallel to each other and comprise rods that extend downward parallel to and offset from the longitudinal axis of quill 13. Links 51 extend past top bracket 47 and locate on opposite sides of a key 53. Key 53 extends radially outward from top bracket 47, and since it is trapped by anti-rotation links 51, it prevents rotation of top bracket 47. Rotation sensor 25 extends radially outward from thread makeup compensator sleeve 21 and is also trapped between the two anti-rotation links 51. This positioning of rotation sensor 25 between rigid links 51 prevents not only rotation of rotation sensor 25 but also any rotation of thread makeup compensator sleeve 21. Other devices could be employed to prevent rotation, such as a device that slidingly engaged a portion of the derrick.

Figure 3:
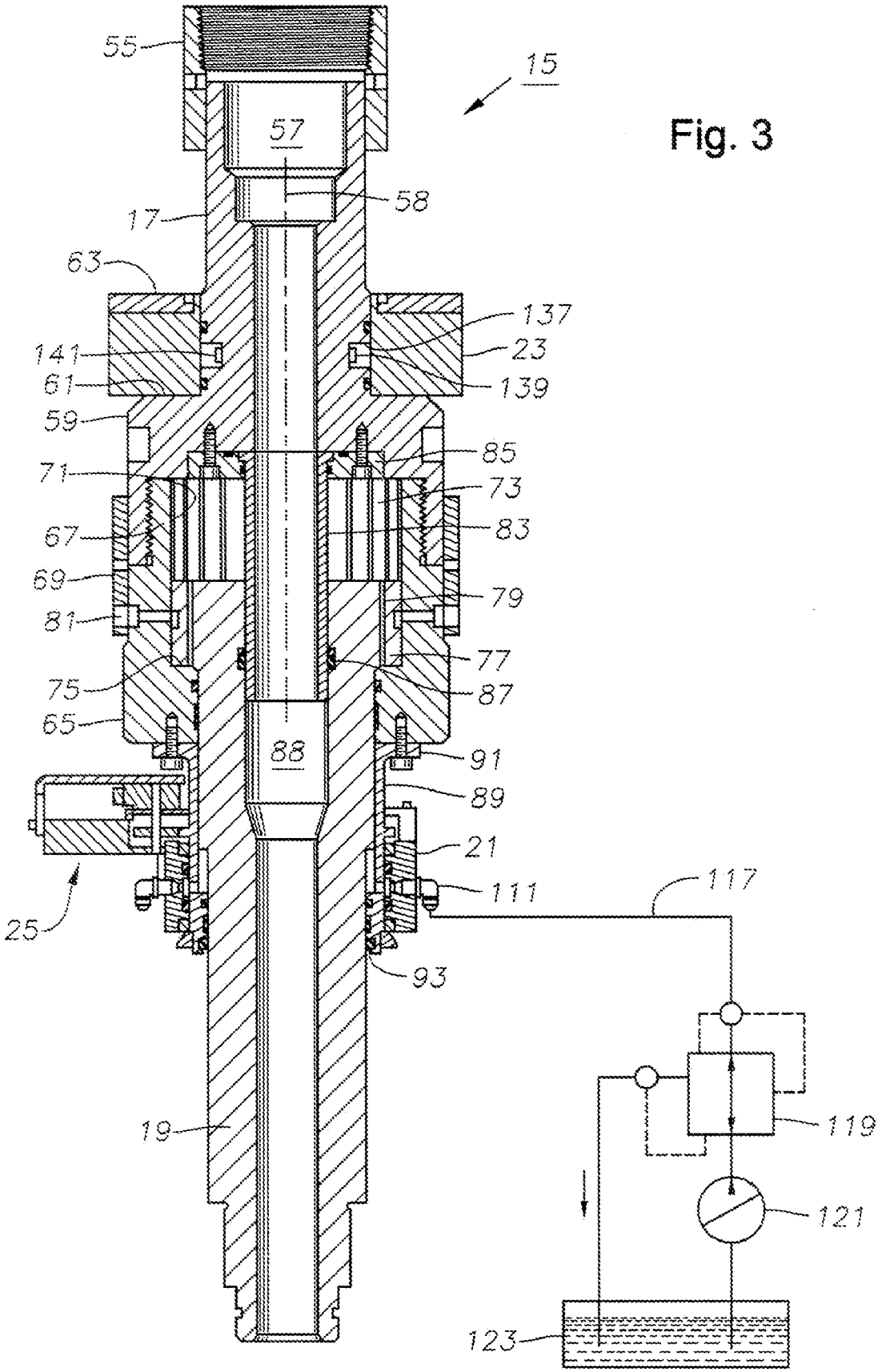
FIG. 3 is an enlarged sectional view of the multi-function sub of FIG. 1.

Referring to FIG. 3, a threaded collar 55 locates on the upper end of upper member 17 of multi-function sub 15. Threaded collar 55 secures to quill 13 (FIG. 1). An axial passage 57 extends through upper member 17 coaxial with an axis 58 of multi-function sub 15. Upper member 17 has an enlarged lower portion 59 that defines an upward facing shoulder 61. Instrument housing 23 fits on shoulder 61. A cover plate 63 of instrument housing 23 allows access to the components within instrument housing 23. Instrument housing 23 is annular, forming a complete circle around upper member 17 in this embodiment.

A retainer 65 is secured to the lower end of enlarged portion 59, such as by threads 67. Retainer 65 has the same outer diameter as enlarged portion 59 and forms part of upper member 17. A torque sleeve 69 may surround and secure enlarged portion 59 to retainer 65 so as to avoid imparting drilling torque to threads 67. Torque sleeve 69 is secured by various fasteners to enlarged portion 59 and retainer 65.

An internal spline cavity 71 is defined by an upper portion of retainer 65 and a lower portion of enlarged portion 59. Spline cavity 71 is coaxial with axis 58. A number of anti-rotation members, such as axially extending splines 73, are formed in the interior sidewall of spline cavity 71. Retainer 65 has an upward facing shoulder 75 that forms a lower end of spline cavity 71. Lower member 19 extends up into spline cavity 71. An enlarged spline head 77 is formed on the upper end of lower member 19. Spline head 77 has mating splines to splines 73. Rotation of upper member 17 is imparted to lower member 19 through splines 73 and spline head 77.

Spline head 77 is capable of traveling axially upward and downward within spline cavity 71. Shoulder 75 serves as a stop to define the extended position for upper and lower members 17 and 19. In the contracted position, spline head 77 will abut the upper end of cavity 71. In this example, spline head 77 is not a piston, thus spline cavity 71 has approximately the same fluid pressure above and below spline head 77 during reciprocating movement of spline head 77. Vents (not shown) may extend from the interior to the exterior of spline cavity 71 both above and below spline head 77 to prevent any differential pressure across spline head 77 within spline cavity 71. Furthermore, spline head 77 may have one or more equalizing ports 79 extending from an upper to a lower side of spline head 77. Equalizing ports 79 allow any fluid contained in spline cavity 71 to communicate from below to above spline head 77. One or more grease nipples 81 extend into spine cavity 71 from the exterior to enable grease or lubricant to be injected into spline cavity 71.

Figure 6:
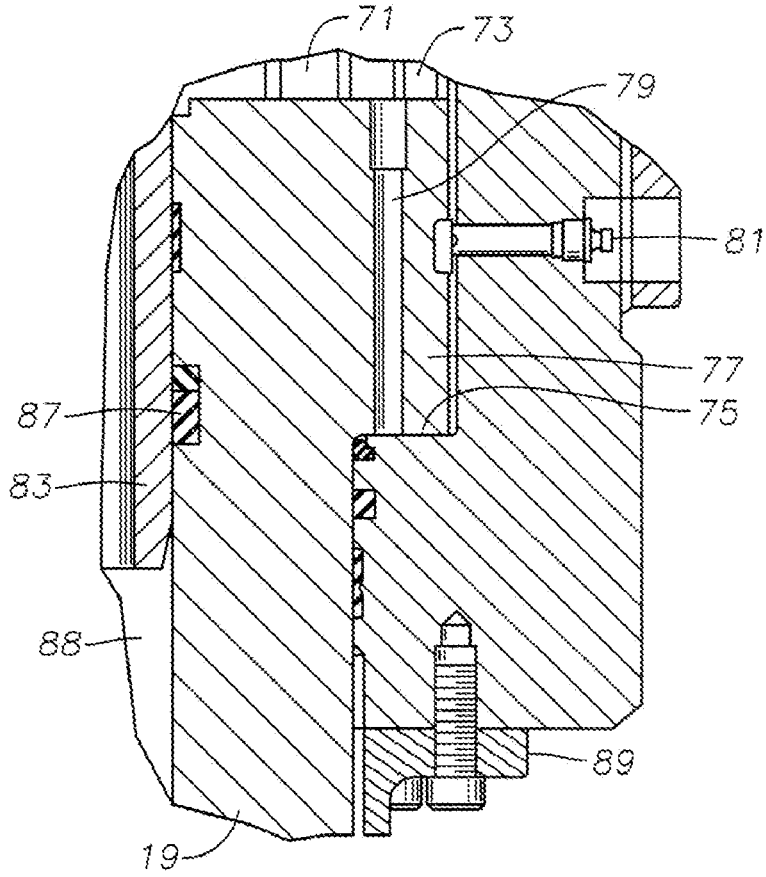
FIG. 6 is an enlarged sectional view illustrating a portion of a spline head and spline cavity for transmitting rotation from an upper to a lower portion of the multi-function sub of FIG. 1.

An isolation tube 83 is secured by a bolted bracket 85 to a lower side of upper member 17 within cavity 71. Isolation tube 83 extends downward into an axial passage 88 of lower member 19. A seal 87 seals between the exterior of isolation tube 83 and the interior of axial passage 88. Axial passage 88 is coaxial with axial passage 57 of upper member 17. Isolation tube 83 allows fluid to be pumped down from top drive 11 (FIG. 1) through passage 57 into axial passage 88 without communicating any of the fluid to spline cavity 71. FIG. 6 illustrates seal 87 in more detail as well as one of the equalizing ports 79. FIG. 6 also shows more detail of the sealing engagement of retainer 65 of lower member 19 below spline head 77.

Referring again to FIG. 3, a compensator sleeve or housing 89 is secured by a bolted flange 91 to a lower end of retainer 65. Compensator housing 89 is a tubular member that extends downward alongside lower member 19. Compensator housing 89 rotates in unison with upper and lower members 17, 19. Lower member 19 is capable of moving axially between its contracted and extended position relative to compensator housing 89. Seals 93 are located within the bore of compensator housing 89 for sealing against the exterior of lower member 19.

Figure 7:
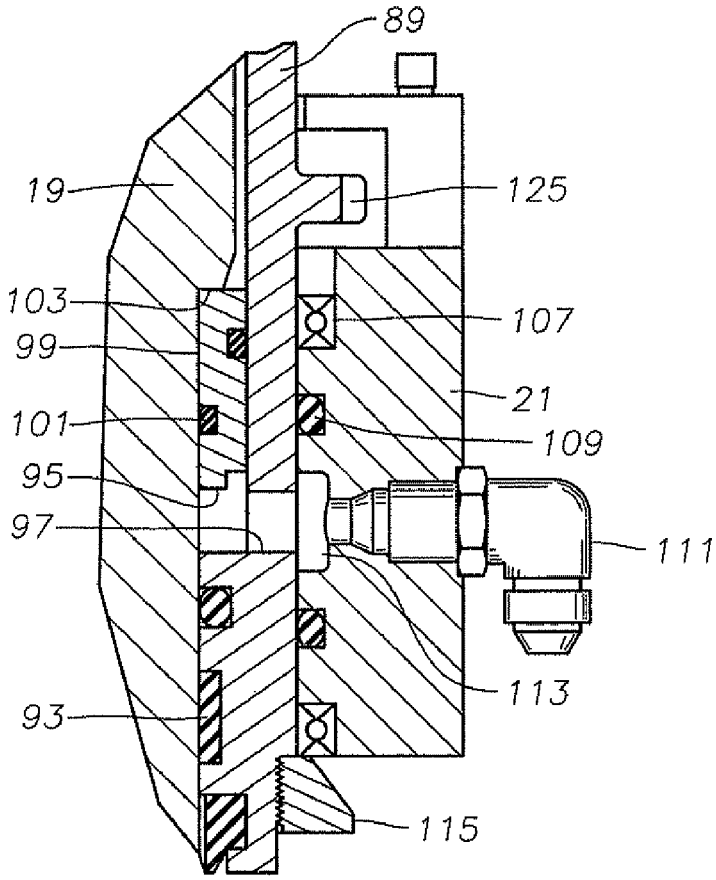
FIG. 7 is an enlarged sectional view of the thread makeup compensator features of the multi-function sub shown in FIG. 3.

Referring to FIG. 7, compensator housing 89 has an internal chamber 95 that is defined partly by a reduced diameter portion of lower member 19. Compensator chamber 95 is annular and has a port 97 that leads to the exterior of compensator housing 89. A piston 99 is located within compensator chamber 95 for upward and downward movement with lower member 19. Piston 99 has seals 101 that seal to the exterior of lower member 19 and seal to the interior of compensator housing 89. Piston 99 abuts a shoulder 103 that faces downward and is located on lower member 19. Piston 99 could be integrally formed with lower member 19, if desired. When compensator chamber 95 is supplied with sufficient pressure, piston 99 will push lower member 19 upward.

Compensator sleeve 21 is mounted on the exterior of compensator housing 89. Compensator sleeve 21 is not intended to be rotated and has bearings 107 at its upper and lower ends to accommodate the relative rotation of compensator housing 89. Seals 109 are located between compensator sleeve 21 and compensator housing 89 for sealing a central annular portion between the two members. A hydraulic fluid fitting 111 secures to a port within compensator sleeve 21. The port leads to a gallery recess 113 that extends around the inner diameter of compensator sleeve 21. Fluid applied to fitting 111 will flow into gallery 113 and come out through port 97 into chamber 95 even when inner member 19 is rotating. Compensator sleeve 21 is held on compensator housing 89 by a retainer nut 115.

Referring to FIG. 3 again, a hydraulic fluid line 117 is connected to fitting 111. Hydraulic fluid line 117 leads to an external pressure regulator 119, which is connected with an external pump 121. Pump 121 draws hydraulic fluid from a reservoir 123 and supplies it through line 117 to fitting 111. Pressure equalizer 119 is a conventional device that retains substantially uniform pressure in line 117. If the pressure within line 117 starts to increase, pressure regulator 119 will divert some of the fluid from line 117 back to reservoir 123. Pressure regulator 119 can be adjusted to a desired pressure.

Figure 8:
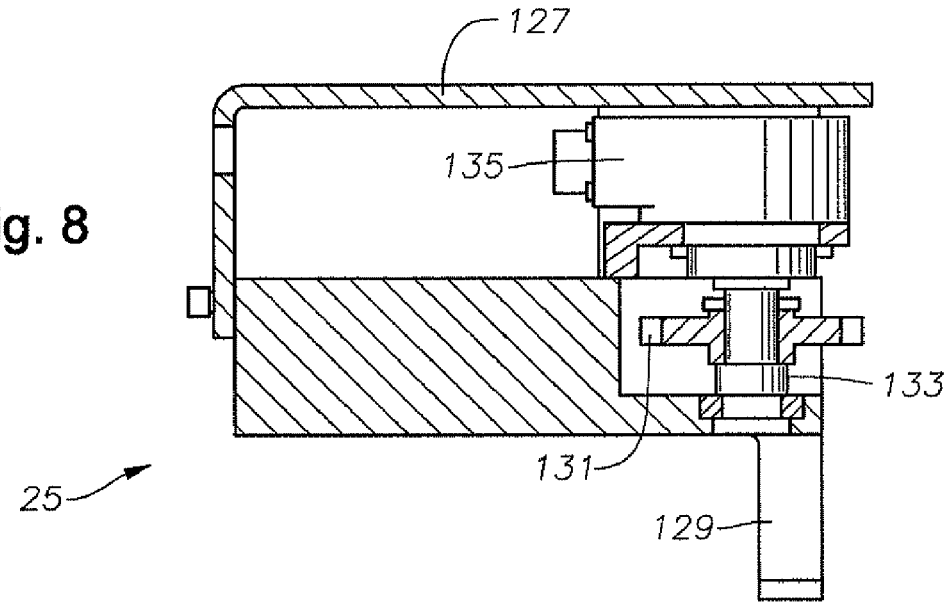
FIG. 8 is an enlarged sectional view of the rotation sensing unit shown in FIG. 4.

Various devices may be employed to sense rotation with rotation sensor 25 (FIG. 1) Referring again to FIG. 7, in this example, the rotation sensing assembly includes a first gear 125 mounted on or integrally formed on compensator housing 89 for rotation with it. First gear 125 is a large gear that extends completely around lower member 19. Referring to FIG. 8, rotation sensor 25 utilizes first gear 125 (FIG. 7) to determine a rotational speed of inner member 19. In this embodiment, rotation sensor 25 includes an encoder housing 127 that has a bracket 129 for mounting to compensator sleeve 21 (FIG. 7). Encoder housing 127 extends radially outward from compensator sleeve 21. A second gear 131 is rotatably received in encoder housing 127 on a vertical shaft 133. Shaft 133 is parallel with longitudinal axis 58 (FIG. 3). Shaft 133 extends into and forms part of an encoder 135. Encoder 135 is a conventional device that measures the rotational speed of shaft 133. Encoder 135 contains various circuitry and preferably a battery and an RF transmitter (not shown). The signals from encoder 135 are transmitted to a receiver (not shown) located at rig floor 41 (FIG. 1).

Referring to FIG. 3, a sensor cavity 137 is formed in multi-function sub 15. In this example, cavity 137 is annular and concentric with axis 58. Sensor cavity 137 may be located a short distance above shoulder 61. A plurality of gages, typically strain gages, are mounted within sensor cavity 137. These strain gages include a torque gage 139 and a tension gage 141. Each is schematically illustrated as being mounted to a cylindrical wall portion or the base of cavity 137.

Figure 5:
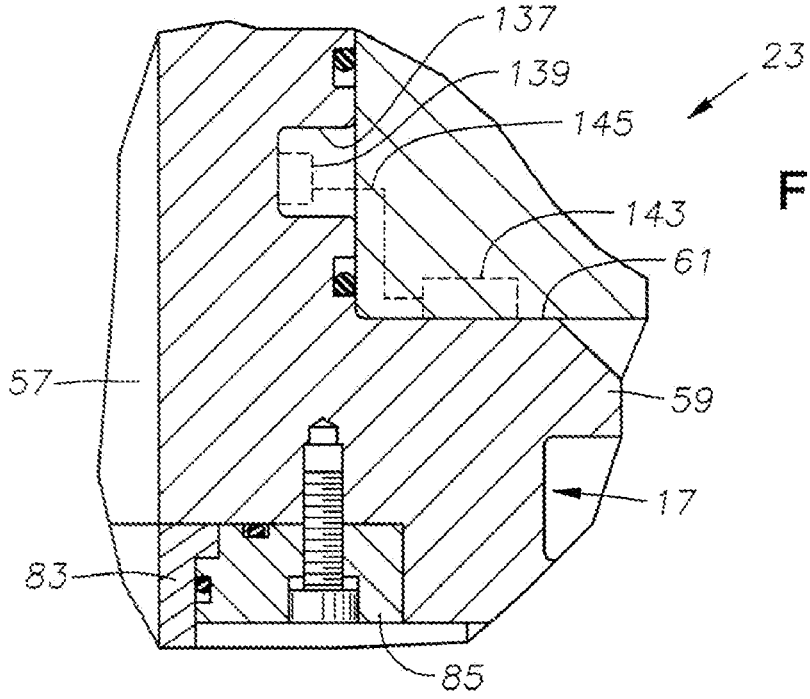
FIG. 5 is an enlarged partial sectional view of a portion of the torque and weight sensing assembly.

Referring to FIG. 5, electrical circuitry, including an RF transmitter 143, is illustrated schematically as being contained within instrument housing 23. Wires 145 lead from gages 139 and 141 (FIG. 3) to the circuitry 143. Instrument housing 23 encloses the open outer side of sensor cavity 137.

Referring to FIG. 1, in operation, multi-function sub 15 will be connected between top drive quill 13 and casing gripper 27. According to FIG. 3, pump 121 will be actuated to supply fluid pressure to chamber 95 (FIG. 7). The fluid pressure will be adjusted to be sufficient to move piston 99 upward, lifting the weight of casing gripper 27 (FIG. 1). The fluid pressure will preferably position spline head 77 (FIG. 3) above shoulder 75 and below bracket 85 in a floating position between the upper and lower ends of cavity 71. Pressure regulator 119 will maintain that amount of fluid pressure substantially constant.

The operator lowers top drive 11, and using the elevator (not shown) attached to bails 43, pivots bails 43 outward with hydraulic cylinders 49 (FIG. 2) to engage new casing joint 33, typically positioned alongside rig floor 41 (FIG. 1) on a ramp. The elevator engages new casing joint 33 below its casing collar and lifts it into axial alignment with top drive 11 and casing string 37. Preferably thread compensator spline head 77 will still be in a floating position between the upper and lower ends of cavity 71 after lifting new casing joint 33. The operator lowers top drive 11 until threads 34 rest on the threads in casing collar 35. The operator continues to lower top drive 11 and casing gripper 27 while new casing joint 33 is stationarily supported by casing string 37. The elevator slides downward around new casing joint 33 below its casing collar as top drive 11 is being lowered. After a few feet, spear 29 will stab into the upper portion of new casing joint 33. The operator actuates casing gripper 27 to move grippers 31 outward to engage the inner diameter of new casing joint 33. The operator then may disconnect the elevator and move it away from new casing joint 33 using hydraulic cylinders 49 (FIG. 2).

Depending upon the precise position of top drive 11, some or all of the weight of casing gripper 27 may still be passing through multi-function sub 15 and supported by top drive 11 before new casing joint 33 is made up to casing string 37. If some of the weight of casing gripper 27 is being supported by new casing joint 33 resting on casing collar 35, the fluid pressure in chamber 95 (FIG. 7) may force piston 99 to the uppermost position. In the uppermost position, spline head 75 (FIG. 3) will be abutting flange 91.

The operator begins to make up threads 34 with casing collar 35 by rotating quill 13. Upper and lower members 17, 19 rotate in unison and transmit rotation to spear 29 and grippers 31 of casing gripper 27. The rotation causes new casing joint 33 to rotate and begin to make up with casing collar 35, which is held in a non-rotating position. During this rotation, anti-rotation links 51, which are not rotating, prevent rotation sensor 25 and key 53 from rotating. Because rotation sensor 25 is held from rotation, compensator sleeve 21 (FIG. 7) will not rotate. Key 53 (FIG. 2) prevents top bracket 47 and bails 43 from rotating.

As casing joint 33 is rotated by top drive 11, the operator holds top drive 11 at a stationary elevation on the derrick. Threads 34 will tend to pull casing joint 33 downward a few inches as they enter and move downward into casing collar 35. This downward movement will cause lower member 19 (FIG. 3) to move downward relative to upper member 17. Spline head 77 moves downward also and may even contact upward facing shoulder 75. Piston 99 (FIG. 7) moves downward with lower member 19. The volume contraction of chamber 95 (FIG. 7) increases the fluid pressure, and pressure regulator 119 (FIG. 3) bleeds off that pressure increase to maintain the pressure at a substantially constant level.

During the makeup rotation, first gear 125 rotates (FIG. 7), which causes rotation of second gear 131, resulting in encoder 135 (FIG. 8) informing the operator of the speed of rotation. It also, if desired, will inform the operator of the number of turns made during the thread makeup rotation. Torque gage 139 and tension gage 141 will provide data to the operator via RF transmitter and circuitry 143 (FIG. 5).

Once fully made up, the operator raises top drive 11 to lift the entire casing string 37 along with new joint 33 and releases spider 39. At this point spline head 77 will be resting on shoulder 75. The operator lowers the string of casing 37 into the well either to drill or to run casing in a previously drilled well. If drilling, the weight imposed on the drill bit at the bottom can be determined by monitoring the signal from tension gage 141 (FIG. 3). That signal will inform the operator of the weight of the casing string 37 before the drill bit reaches bottom, and the weight after the drill bit reaches bottom. During drilling, upper and lower members 17, 19 will continue to rotate with casing string 37 while compensator sleeve 21 (FIG. 7) remains stationary. Rotation sensor 25 through gears 125, 131, will provide signals to the operator of the rotational speed. During drilling, there is no need to maintain fluid pressure in line 117 from pump 121.

While the invention has been shown in only one of its forms, it should be apparent to those skilled in the art that it is not so limited thus susceptible to various changes without departing from the scope of the invention.

The invention claimed is:

1. An apparatus for use in running a string of casing into a well, comprising:

a telescoping sub having a longitudinal axis and tubular first and second members that are axially and telescopingly movable relative to each other and rotatable in unison with each other;

the first and second members adapted to be connected between a top drive assembly and a casing gripping device for transmitting rotation from the top drive-assembly to the casing gripping device;

a piston on the second member reciprocally carried within a chamber defined by the first member;

the chamber containing a pressurized fluid that acts against the piston to bias the first and second members toward the contracted position, such that while the top drive assembly is supporting the weight of the casing gripping device, the first and second members can move toward an extended position as the top drive assembly rotates a casing joint gripped by the casing gripping device into threaded engagement with a casing string;

a torque measuring gage mounted on the sub for measuring torque applied by the ton drive assembly to make up the casing joint with the casing string;

a spline cavity within the first member;

a spline head on the second member that is carried within the spline cavity, the spline cavity and the spline head having mating splines;

the spline head being axially movable in the spline cavity between upper and lower stops, allowing the telescoping movement of the first and second members;

a sleeve axially spaced from the spline cavity, mounted to the first member and enclosing the chamber;

an anti-rotation member that prevents rotation of the sleeve with the first and second members;

the piston being reciprocally carried within the sleeve; and an external source of pressurized fluid connected by a line to a port within the sleeve during operation of the apparatus for supplying the pressurized fluid to the chamber.

2. The apparatus according to claim 1, wherein the source comprises:

a pump; and a pressure regulator for maintaining a substantially constant fluid pressure in the sleeve during operation of the apparatus.

3. The apparatus according to claim 1, further comprising:

a sensor cavity formed on an exterior portion of the sub;

the torque gage being mounted in the sensor cavity;

a housing mounted over the sensor cavity; and an RF transmitter electrically connected to the torque gage and mounted in the housing for transmitting a signal corresponding to the torque being sensed by the torque gage.

4. The apparatus according to claim 3, further comprising a tension gage for measuring tension in the sub, the tension gage being mounted in the sensor cavity and electrically connected with the RF transmitter.

5. The apparatus according to claim 1, wherein:

the spline head has an open port extending from a lower end of the spline head to an upper end of the spline head, to prevent a pressure differential between the upper and lower ends of the spline head.

6. An apparatus for use in running a string of casing into a well with a drilling rig having a top drive, comprising:

a telescoping sub having a longitudinal axis and tubular first and second members that are axially and telescopingly movable relative to each other and rotatable in unison with each other, an upper end of the sub adapted to be connected to the top drive;

a casing gripping device connected to a lower end of the sub and having a movable gripper for engaging a joint of casing;

a spline cavity within the first member;

a spline head on the second member that is carried within the spline cavity, the spline cavity and the spline head having mating splines;

the spline head being axially movable in the spline cavity between upper and lower stops, allowing the telescoping movement of the first and second members;

a sleeve mounted to an exterior portion of the first member;

an anti-rotation member that prevents rotation of the sleeve with the first and second members;

a piston on an exterior portion of the second member and reciprocally carried within the sleeve; and an external pump connected by a line to the sleeve for supplying pressurized fluid into the sleeve during operation of the apparatus, which acts against the piston to bias the first and second members toward a contracted position to provide thread make-up compensation when the top drive makes up the joint of casing with a string of casing.

7. The apparatus according to claim 6, wherein the anti-rotation member comprises:

a rigid link connected to a stationary portion of the top drive and extending down into cooperative engagement with the sleeve.

8. The apparatus according to claim 7, further comprising:

a rotation sensing device having a non-rotating portion mounted on and extending outward from the sleeve, the rigid link contacting the rotation sensing device to prevent rotation of the sleeve; and a rotating portion of the rotation sensing device mounted to the first member for rotation therewith and in cooperative engagement with the non-rotating portion.

9. The apparatus according to claim 7, further comprising:

a pair of elevator bails pivotally mounted to a non-rotating portion of the casing gripping device; and wherein the rigid link also engages the non-rotating portion of the casing gripping device to prevent rotation of the non-rotating portion of the casing gripping device.

10. The apparatus according to claim 6, further comprising:

a pressure regulator connected between the pump and the sleeve for maintaining a substantially constant fluid pressure in the sleeve during operation of the apparatus.

11. The apparatus according to claim 6, further comprising:

a sensor cavity formed on an exterior portion of the first member;

a torque gage being mounted in the sensor cavity;

a housing mounted over the sensor cavity; and an RF transmitter electrically connected to the torque gage and mounted in the housing for transmitting a signal corresponding to the torque being sensed by the torque gage.

12. The apparatus according to claim 6, further wherein:

the spline head has an open port extending from a lower end of the spline head to an upper end of the spline head, to prevent a pressure differential between the upper and lower ends of the spline head.

13. The apparatus according to claim 12, further comprising:

co-axial passages in the upper and lower members to enable fluid to be pumped from the top drive through the sub;

an isolation tube mounted to the co-axial passage of the first member and extending through the spline cavity into sealing engagement with the co-axial passage in the second member to transmit fluid from one co-axial passage to the other without entering the spline cavity.

* * * * *